US009084925B2

(12) United States Patent
Davenport et al.

(10) Patent No.: US 9,084,925 B2
(45) Date of Patent: Jul. 21, 2015

(54) GOLF SWING ANALYSIS APPARATUS AND METHOD

(75) Inventors: Roger Davenport, Ft. Lauderdale, FL (US); Paul Reynolds, Mountain View, CA (US)

(73) Assignee: Golf Impact, LLC, Fort Lauderdale ( * ) Notice: Subject to any disclaimer, the term of this patent is extended or adjusted under 35 U.S.C. 154(b) by 1724 days.

(21) Appl. No.: 12/287,303

(22) Filed: Oct. 9, 2008

(65) Prior Publication Data

US 2010/0093463 A1 Apr. 15, 2010

(51) Int. Cl.

| | |
|---|---|
| ***A63B 69/36*** | (2006.01) |
| ***A63B 53/04*** | (2015.01) |
| *A63B 71/06* | (2006.01) |

(52) U.S. Cl.

CPC ..... *A63B 69/3632* (2013.01); *A63B 53/0466* (2013.01); *A63B 2053/0416* (2013.01); *A63B 2071/063* (2013.01); *A63B 2071/0625* (2013.01); *A63B 2220/40* (2013.01); *A63B 2220/56* (2013.01); *A63B 2225/50* (2013.01)

(58) Field of Classification Search

USPC ..... 473/223, 151, 225, 222

See application file for complete search history.

(56) References Cited

U.S. PATENT DOCUMENTS

| | | | | |
|---|---|---|---|---|
| 6,196,932 | B1 * | 3/2001 | Marsh et al. | 473/223 |
| 6,248,021 | B1 * | 6/2001 | Ognjanovic | 473/131 |
| 7,691,004 | B1 * | 4/2010 | Lueders | 473/222 |
| 2005/0215340 | A1 * | 9/2005 | Stites et al. | 473/233 |
| 2006/0276256 | A1 * | 12/2006 | Storek | 473/221 |
| 2008/0085778 | A1 * | 4/2008 | Dugan | 473/223 |
| 2009/0023511 | A1 * | 1/2009 | Meyer et al. | 473/290 |
| 2009/0143159 | A1 * | 6/2009 | Murph et al. | 473/239 |
| 2009/0165530 | A1 * | 7/2009 | Golden et al. | 73/12.02 |
| 2009/0209358 | A1 * | 8/2009 | Niegowski | 473/223 |
| 2010/0049468 | A1 * | 2/2010 | Papadourakis | 702/141 |
| 2011/0230986 | A1 * | 9/2011 | Lafortune et al. | 700/93 |

* cited by examiner

*Primary Examiner* — Kang Hu
*Assistant Examiner* — Syvila Weatherford

(57) ABSTRACT

A method and integrated golf club apparatus for directly measuring physical parameters of the golf club head motional acceleration swing forces, golf club head face, golf ball impact forces, and subsequent calculations of other metrics useful to a golfer's understanding of the effectiveness of his or her golf swing and impact result in totality. The physical parameters that are directly measured include three dimensional motion force vectors of club head prior to, during and after impact and full impact pressure force profiles across the golf clubface with respect to time. The sensors are connected to electronics which condition, record and store the time varying sensors information electronically, then process and translate the information into one of several forms for delivery to a human interface function.

20 Claims, 18 Drawing Sheets

GOLF SWING ANALYSIS APPARATUS AND METHOD

FIELD OF THE INVENTION

The present invention relates to a method for determining the effectiveness of a golfer's swing and the associated golf club head time varying force metrics before, during and after impact between a golf club head and a golf ball. More specifically, the present invention relates to an integrated golf club capable of autonomous direct measurement and information storage of three dimensional motional acceleration forces of the club head during the swing, and complete club head and ball impact time varying force profiles across the entire club head face.

BACKGROUND OF THE INVENTION

For several decades, external systems separate from a golf club, or attaching sensors to a golf club, have been used to gather and infer information about the effectiveness of a golfer's swing. One of the most common external systems relates to using high speed cameras to determine metrics about a golfer's swing. Some of these systems estimate club head speed and ball speed and spin after the ball leaves the club. However, the true forces introduced in the clubface and the club/ball impact information are estimates based upon indirect calculations of force inferred from optical images.

The approach of using prior art golf club attachments can identify to an unacceptable approximate degree the impact area on the clubface. However, the precise location cannot be achieved because of the removable nature of the sensors and the lack of relationship of time varying force profiles of each sensor which is needed for a full energy impact analysis.

An example of such an external system is U.S. Pat. No. 4,136,387 to Sullivan et al., for a Golf Club Impact And Golf Ball Launching Monitoring System. Sullivan discloses a system that uses external electro-optical sensors to measure the location of a plurality of spots on the surface of the golf club head or the golf ball, each at two points in time. For the golf club head measurement the two points in time are just before ball impact; for the two points in time for the golf ball, it is after impact. This device does not offer an integrated golf club and does not allow for direct force measurements of the time varying spatial and force profiles across the clubface and club head accelerations' forces for accurate force dynamics associated with the club swing and clubface/ball impact.

Another example of an external system is the Patent Application Publication U.S. 2008/0020867 A1 to Manwaring for a method of determining a golfer's golf club head orientation and impact location for a golf swing. The system uses an optical CMOS imaging system to measure angular velocity of the golf club, linear velocity of the golf club, and ball launch properties. Then, through iterative calculations using the mass of the golf club and the ball, the device makes determinations as to club head orientation and clubface impact. This publication does not offer an integrated golf club and does not allow for direct force measurements of the time varying spatial and force profiles across the clubface and club head accelerations' forces for accurate force dynamics associated with the club swing and clubface/ball impact.

Another example of an external system is shown in U.S. Pat. No. 7,329,193 B2 to Plank, Jr. who claims a portable golf swing analyzing system separate from the golf club based on infrared sensors and ultrasonic sensors. This publication does not offer an integrated golf club and does not allow for direct force measurements of the time varying spatial and force profiles across the clubface and club head accelerations' forces for accurate force dynamics associated with the club swing and clubface/ball impact.

An example of attaching sensors to a golf club is shown in U.S. Pat. No. 4,898,389 to Plutt, who claims a self contained device for indicating the area of impact on the face of the club and the ball, and a means for an attachable and detachable sensor or sensor array that overlies the face of the club. Plutt's device does not provide for an imbedded impact sensor array in the clubface that functions in conjunction with internal three dimensional g-force sensors to provide a superset of time varying spatial force impact contours of the clubface with club head acceleration force parameters that can be calibrated for highly accurate spatial and force measurement. Plutt's device is susceptible to location inaccuracy due to the removable constraint of the sensors and is susceptible to sensor damage since the sensors come in direct contact with the ball.

Another example of attaching sensors to a golf club is shown in U.S. Pat. No. 7,264,555 B2 to Lee et al. which claims a diagnostic golf club system that utilizes a golf club with strain gauges or other swing load measuring means attached to the golf club shaft to determine swing characteristics. This device does not utilize sensors embedded with in the club head.

Another example of attaching sensors to a golf club is U.S. Pat. No. 5,792,000 to Weber et al. which claims a swing analysis system that analyzes sensors placed on the shaft of the golf club. This device does not utilize sensors embedded within the club head.

The prior art disclosures all fail to offer a fully integrated golf club capable of autonomously making time varying direct force measurements with regards to three dimensional motional forces of the club head before, during and after golf club head/ball impact, and making direct time varying force measurements across the clubface surface. Accordingly, none of the prior art aggregates all of these direct measurements with respect to a single time line allowing a large number of metrics to be calculated.

SUMMARY OF THE INVENTION

The present invention is an integrated golf club that measures directly and stores time varying forces during the golf club swing in the time span around the point of golf club head and ball impact. Two categories of time varying forces are being measured in real time simultaneously with different mechanisms.

The first category of measured forces includes three dimensional motional acceleration forces on the club head during the club swing from a point in time before the initial club/ball impact until a point in time after club head and ball separation has taken place. The relationship between force and acceleration is $\vec{F}(t)=m_{ch}\vec{a}(t)$ where $\vec{F}(t)$ is the time varying force vector, $m_{ch}$ is the known mass of the club head and $\vec{a}(t)$ is the time varying acceleration vector experienced by a given acceleration force sensor. The three dimensional axial domain of the acceleration force vectors has its origin at the center of gravity and the axial domain is orientated with one axis referenced normal to the club head face. The mechanism used to measure this category of motional forces is a three dimensional g-force acceleration sensor or sensors.

The second category of force measurements includes the impact pressure forces that occur across the golf club head face for the duration of clubface and ball impact. This time varying pressure force is a scalar pressure profile normal to the clubface that is a result of the impact force and location of the ball on the clubface. The relationship between pressure and force is $P(t)=\vec{F}_{normal\text{-}to\text{-}A}(t)A$ where P(t) is the time varying pressure experienced by a given pressure force sensor, $\vec{F}_{normal\text{-}to\text{-}A}(t)$ is the time varying vector component of the force vector that is normal to the surface of the pressure force sensor and also the clubface, and A is the surface area of a given pressure force sensor. The axial reference domain is the same for the g-force sensors described above. The mechanism to measure this category of pressure forces is an array or pressure force sensors embedded in the clubface that are measuring time varying impact pressure forces across the clubface during the entire duration of club head face and ball impact.

Both categories of dynamic direct vector measurements are related with a single time line and a single shared physical domain allowing a large number highly accurate golf club swing, club/ball impact and club head to ball orientation metrics to be realized. To achieve this aggregate of direct physical measurements, the golf club head has embedded within it at least one acceleration three dimensional g-force sensor and at least one, but preferably a plurality of impact pressure force sensors geometrically distributed in the club head face. From the aggregate related measurements of these two measurement systems associated with a single time line and a defined spatial relationship to each other and to the club head physical structure, the following metrics are either directly measured or directly calculated (If a metric calculation requires an assumption, such as ball surface condition and hence friction coefficient, its is stated as an estimate):

1. Time varying pressure or force profile across the golf clubface;
2. Location of impact of clubface and ball on clubface;
3. Duration in time of club head face and ball impact;
4. Maximum pressure or force measured on clubface;
5. Total energy transferred from club to ball;
6. Time varying three dimensional motional acceleration and associated force vectors on club head before, during and after club head face and ball impact;
7. Radial acceleration forces on club for estimation of club head velocity;
8. Three dimensional deceleration force vectors of club head during the club/ball impact;
9. Force vector components that are transferred to ball launch and ball spin;
10. Estimated percent of total energy components transferred to ball trajectory and ball spin;
11. Club head orientation with respect to ball from before club head/ball impact, during ball impact and after impact;
12. Orientation of ball spin referenced to club head face;
13. Estimation of ball launch velocity;
14. Estimation of ball spin velocity;
15. Impact error offset on clubface which is a distance from actual impact location to optimum impact location;
16. Club head orientation percentage error from optimum in relation to club head/ball impact (This could be described as a error for each of three vectors describing forces on club head from ball) and;
17. Measure of torque and angular momentum of the club head as caused by the event of club head/ball impact.

The sensors are connected to electrical analog and digital circuitry, also embedded in the club head, that condition the signals from the sensors, samples the signals from all sensors simultaneously, converts to a digital format, attaches a time stamp to each group of simultaneous sensor measurements, and then stores the data in memory. The process of sampling sensors simultaneously is sequentially repeated at a fast rate so that all forces' profile points from each sensor are relatively smooth with respect to time. The minimum sampling rate is the "Nyquist rate" of the highest significant and pertinent frequency domain component of the sensors' time wave for any of the sensors.

Thus, the present invention encompasses a variety of options for the golfer to receive and interpret the information of swing, impact and orientation metrics or a subset of total metrics available. The human interface function can be either integrated into the club or a separate human interface module that the golf club communicates with either through wires or wirelessly. The human interface function can be all or any subset of audible, visual, temperature or vibration signals for human interpretation.

A further advantage of the present invention is that in its preferred embodiment, the integrated club communicates with an external human interface apparatus through a wireless connection. The wireless connection could be Bluetooth™, Zigbee™, Wifi or any number of standardized or non standardized radio frequency communication links. There are many possible implementations for the human interface apparatus that support both visual and audio content for human interpretation. Some examples are: laptop computer, palmtop computer, PDA, smart phone, or a thick or thin client video audio custom device. For purposes of descriptive clarity, the preferred embodiment will use a wireless Bluetooth™ data link, and the human interface apparatus is a laptop computer.

Therefore, the preferred embodiment the integrated golf club, in addition to the previous described electronics, also has data formatting for wireless transport using Bluetooth™ transceiver protocols. The data, once transferred over the wireless link to the laptop computer, are processed and formatted into visual and or audio content with a proprietary software program specific for this invention. Examples of user selectable information formats and content could be:

1. a dialog window showing a graphical representation of the clubface using a color force representation of the maximum force gradient achieved conveying the area of impact of the ball and along the side the graphic could show text describing key metrics such as maximum force achieved, radial acceleration of club at impact (related to club head velocity) and total energy transferred to the ball;
2. a motion video of the time varying nature of the forces on the clubface;
3. a three dimensional graphic showing force vectors on club head from ball;
4. an audio response which verbally speaks to the golfer telling him/her the desired metrics;
5. a video showing time varying acceleration vectors of the golf club head during the swing and through impact; or
6. numerous other combinations of audio and visual user defined.

Still yet another advantage of the present invention provides for the integrated golf club that can be battery operated, or have batteries that are rechargeable or replaceable.

BRIEF DESCRIPTION OF DRAWINGS

The above and other features of the present invention will become more apparent upon reading the following detailed description in conjunction with the accompanying drawings, in which.

DETAILED DESCRIPTION OF A PREFERRED EMBODIMENT

The present invention comprises an integrated golf club that measures directly and stores time varying forces during the golf club swing in the time span from before the golf club head and ball impact, to a point in time after club head and ball separation. Two categories of physical parameters are being measured in real time simultaneously with different mechanisms that both convert directly to time varying force vectors. The force vectors from each measurement mechanism are interdependent in time and fixed spatial relation to one another as the club head transitions through all of the different dynamic forces during a golf swing, ball impact and after impact.

Figure 1:
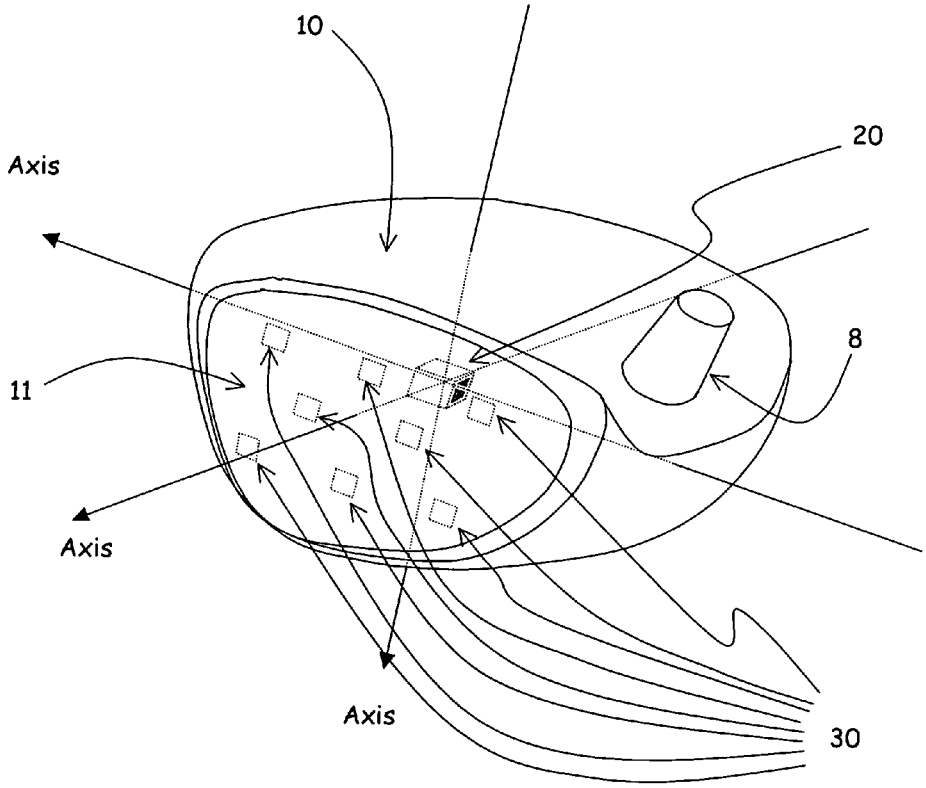
FIG. 1 is a perspective view of the present invention integrated golf club head (golf club shaft not shown) with impact pressure force sensors embedded in the clubface and a three dimensional g-force acceleration sensor inside the club head.

As shown in FIG. 1, the golf club head 10, has a three dimensional g-force acceleration sensor 20 mounted in the center of the club head. In one of many embodiments for this invention, the sensor can be placed at the center of gravity of the club head 40 (FIG. 4) for simplification of metric calculations. However, the sensor does not have to be located at the center of gravity and all metrics defined are still achievable. The club head 10, also has an array of impact pressure force sensors 30 embedded in the golf club head face 11. The hose 18 on club head 10 holds the shaft (not shown) of the club.

Figure 2:
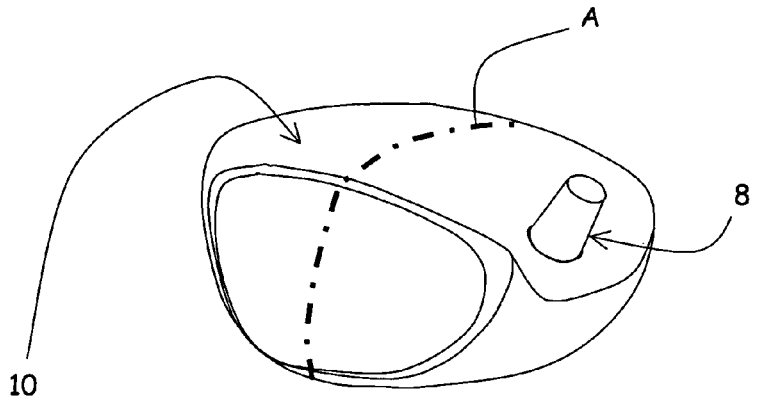
FIG. 2 is a perspective view of the present invention as shown in FIG. 1 except showing dashed line A and without depiction of the sensors.
Figure 2A:
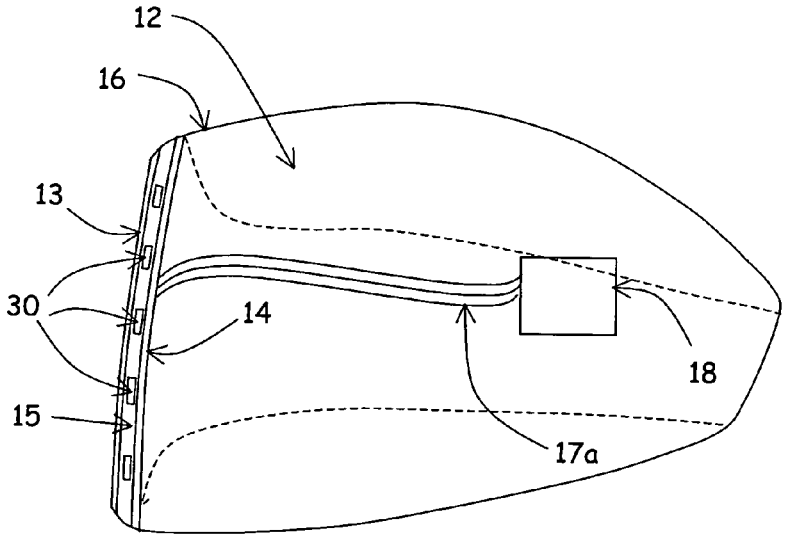
FIG. 2A is a cross sectional view of the club head of the present invention of FIG. 2 taken along line A showing clubface structure with two metal layers and therebetween the impact pressure force sensors and embedding material.
Figure 2B:
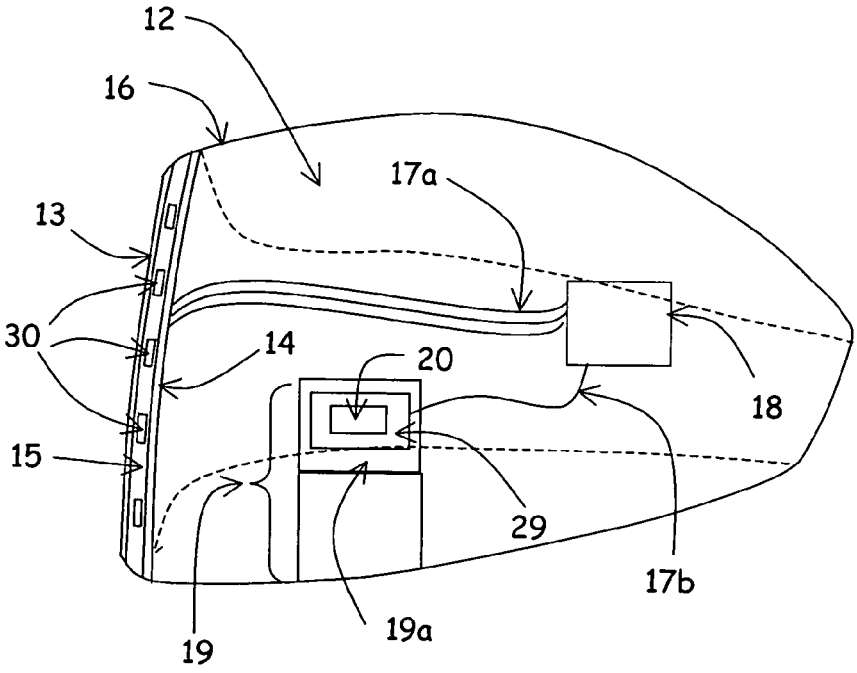
FIG. 2B is a cross sectional view of the club head of the present invention of FIG. 2 taken along line A showing the clubface structure with two metal layers therebetween the impact pressure force sensors and embedding material, and including placement of a three dimensional g-force acceleration sensor.

As shown in FIGS. 2, 2A and 2B the club head 10 and a club head cross section 12 show the construction of the clubface 11 having two metal layers, the outer metal layer 13 and the inner metal layer 14. The pressure force sensors 30 are imbedded in a non-metallic, non-electrical conducting medium of optimum physical properties 15 between the two metal layers as part of the clubface 11. The non-conducting medium 15 is a hard epoxy or similar material monolith structure with the pressure sensors 30 and their electrical connections embedded within it. Some examples of possible materials include UV curable epoxies such as UV Cure 60-7105™ or medium to hard composition of Vantico™ or one of the compositions of Araldite™. The monolith structure can be created with exact pressure sensor placement and orientation with known injection molding technologies. An example of this process would be to make an injection mold that creates half of the monolith structure and has half pockets for a precise fit for each of the sensors and electrical connection ribbon. The sensors with electrical connections are then placed in the preformed pockets of the initial half monolith. The initial half monolith with sensors is then placed in a second injection mold which completes the entire monolith. The sensors 30 are attached to a flex circuit ribbon 17*a* that will extend out from the monolith structure, through a small pass through opening in the inner layer 14, that connects to the electronics assembly 18 in the club head cavity.

The non-conducting monolith material 15 with embedded pressure sensors 30 can be pressure fit between the outer layer 13 and the inner layer 14. The outer layer 13 and the inner layer 14 can be connected to the club head housing 16 with conventional club head construction techniques utilizing weld seams. Some techniques might include Aluminum MIG (Metal Inert Gas) welding for aluminum to aluminum connection and brazing for aluminum to titanium connections. The clubface layers 13 and 14 can be titanium or comparable metal or alloy and the club head housing components can be an aluminum alloy.

As seen in FIG. 2B, the mounting of the three dimensional acceleration force sensor 20 will be attached to a small printed circuit board 29 that holds the three dimensional sensor 20 or combination of one or two dimensional sensors 20 to give three dimensional measurement capabilities. The small printed circuit board 29 will be attached with a durable adhesive to a metal or non-metallic rigid protrusion 19 attached to the club housing either by adhesive, weld, fastener, or other well known connection means, and extending to the spatial location that is predefined for the sensor. The printed circuit board 29 is electrically connected with electronics assembly 18 with a flex ribbon 17*b*. The surface areas 19*a* of the protrusion 19 on which the sensor's printed circuit board is mounted has a defined orientation within the club head to align the acceleration measurement axis with the pre-defined reference axis of the club head.

Figure 3:
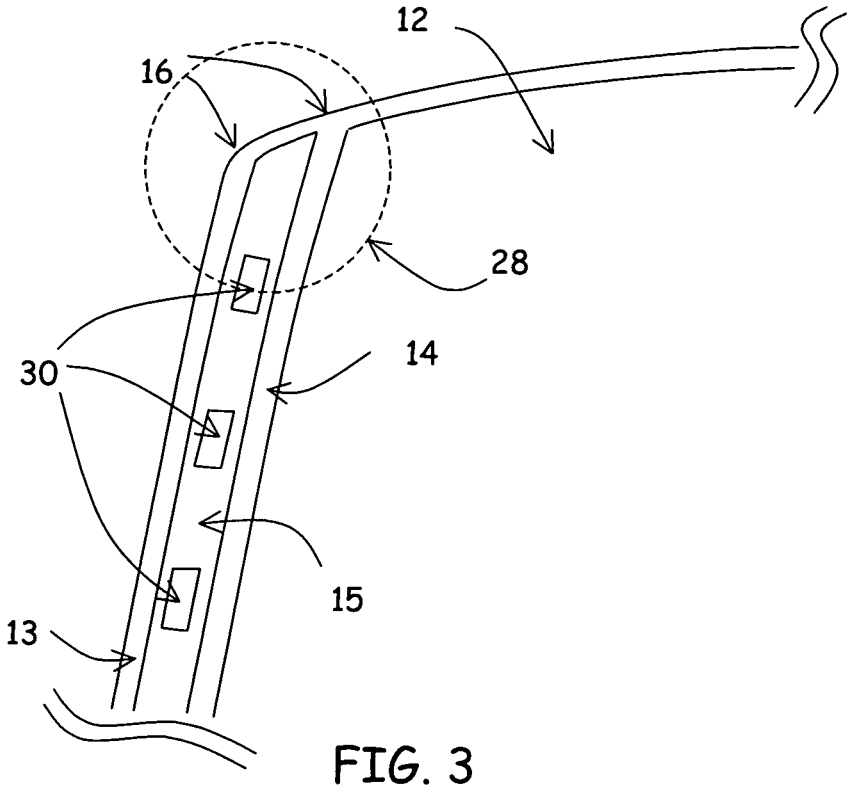
FIG. 3 is a partially exploded cross sectional view of the club head face construction of the present invention showing two metal layers both rigidly attached the club head housing.

As shown in FIG. 3, which is the preferred embodiment of the present invention, the inner metal layer 14 is more rigid than the outer clubface layer 13. Both the outer layer 13 and the inner layer 14 are rigidly attached to the club housing 16 through the aforementioned welding process. In this configuration, the pressure exerted and resulting deformation on the clubface outer layer 13 by the golf clubface 11 and ball create a time varying pressure profile on the non-metallic medium monolith 15. The individual pressure sensors 30 each generate an output voltage proportional to the pressure experienced by that sensor. The pressure sensors 30 in the preferred embodiment are piezoelectric elements of the same surface area and thickness, therefore generating identical pressure force versus voltage profiles. In the case where the clubface inner 14 and outer 13 metal layers are both rigidly connected to the club head shell housing 16, the deformation of the monolith 15 will be less near the edge 28 of the clubface. This means that less pressure will be measured for the same impact force by sensors closer to the edge of the club. These variations will be a constant with respect to the fixed geometric shape of the club head and can be calibrated out in the digital signal process with fixed calibration coefficients programmed into the processing. Calibration could also be done during production on a per club basis.

Figure 4:
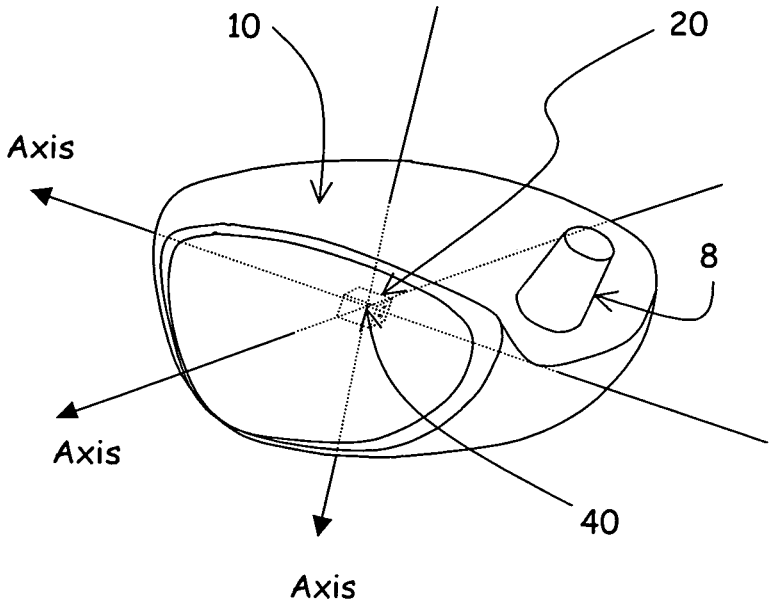
FIG. 4 is a perspective view of the present invention illustrating a three dimensional g-force sensor located at the center of gravity of the club head.
Figure 14:
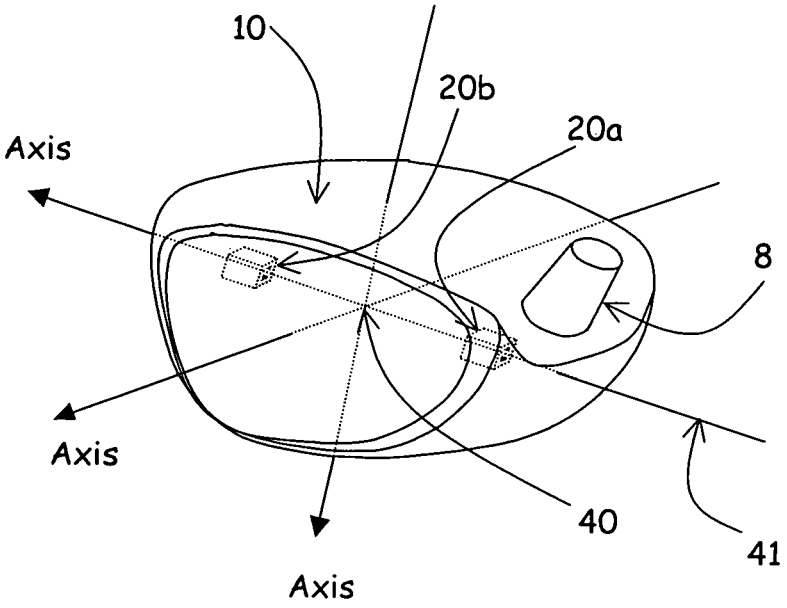
FIG. 14 is a perspective view of an alternative embodiment of the present invention depicting a golf club head embodiment using two, three dimensional g-force sensors.

FIG. 4 shows an embodiment with only one three dimensional g-force sensor 20 mounted at the center of gravity 40 of the club head 10. This configuration, in association with data from the pressure force sensor array, can calculate all of the metrics listed earlier. However, since there is only a single point to measure club head rotation around the center of gravity and it is at the center of gravity, the radial acceleration vector sum is small and a very high resolution of the signal measurement is required. A preferred method of maintaining accuracy and lowering the measurement resolution requirement is to use more than one three dimensional g-force sensors offset from the center of gravity as seen in FIG. 14.

Figure 5:
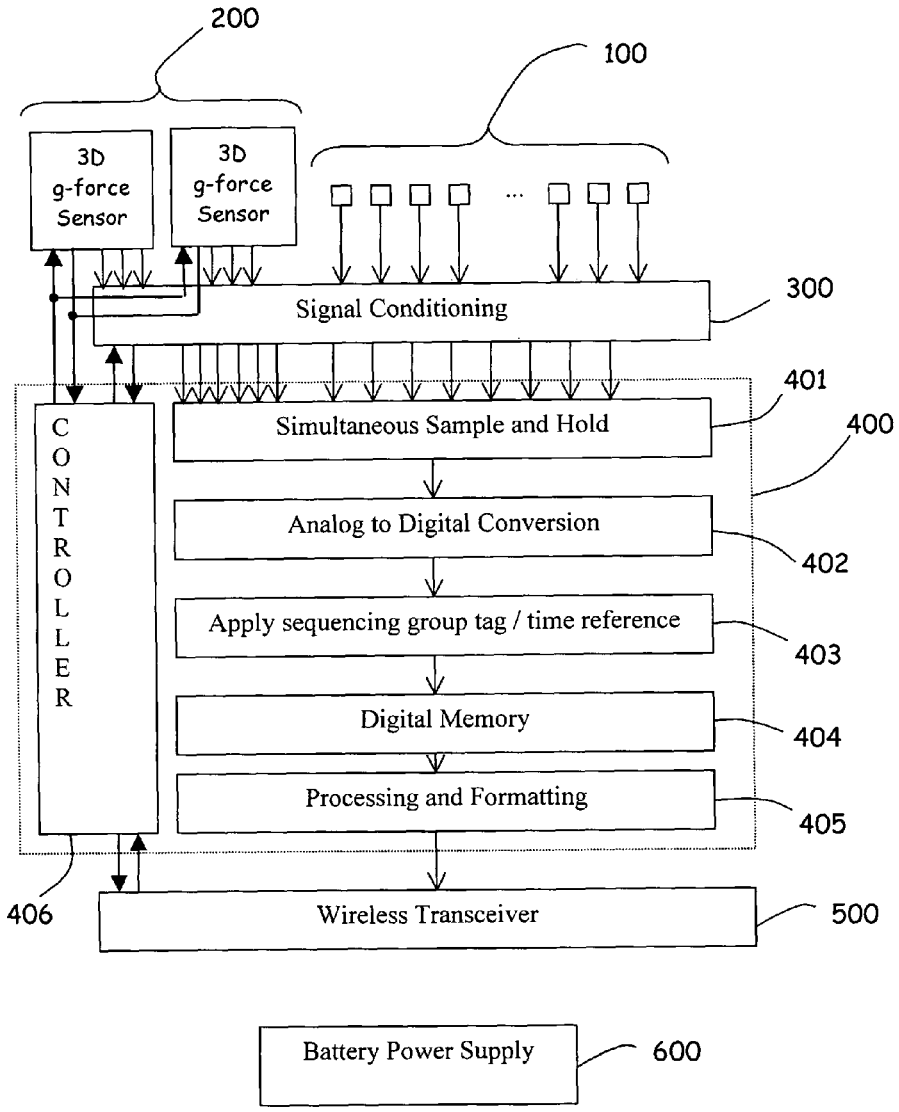
FIG. 5 is a block diagram of sensors and electronic processing functions inside of integrated golf club of the present invention.

As shown in FIG. 5, the two sensor categories, both three dimensional g-force sensor or sensors 200 and the pressure force sensors 100 are connected to electronics that capture the time varying electrical signals of all of the sensors simultaneously. The electrical signals may or may not use signal conditioning 300 before they are input to the simultaneous sample and hold function 401. The simultaneous sample and hold function 401 samples all sensor inputs and at a single point in time then holds the value of each independent sensor for a short period of time. During this short duration in time, the analog to digital conversion function 402 takes each sample value and converts it to a digital representation. All of the digital samples for each sensor are associated with that single sample time of acquisition in "the apply sequencing group tag and time reference" function 403 and are then moved into digital memory 404. The sampling rate of the simultaneous sample and hold function 401 is at, or faster than, the "Nyquist rate" determined by the highest pertinent frequency component of all of the time varying analog sensor inputs. After all data has been loaded into memory storage 404 from a given golfer's swing, additional swing data can be captured and stored or the data is further processed and formatted 405 for transfer to a user interface function. All of the functions listed are coordinated by a controller function 406, which may be integrated together with other functions 400 such as a sophisticated PIC (Periphery Interface Control) module with DSP (Digital Signal Processing) functionality such as Motorola's HC11, HC12 and HC16 micro controller families and MicroChip's dsPIC30 and dsPIC33 families. In a preferred embodiment, the signal is processed and formatted 405 to be applied to a wireless transceiver 500, where it is transferred to a remote user interface such as a laptop computer. All of the functions in FIG. 5 that require electrical power to function are supplied by a battery power supply 600 that is detachable from the integrated golf club or rechargeable if it is implemented as a permanent component of the golf club.

Figure 6:
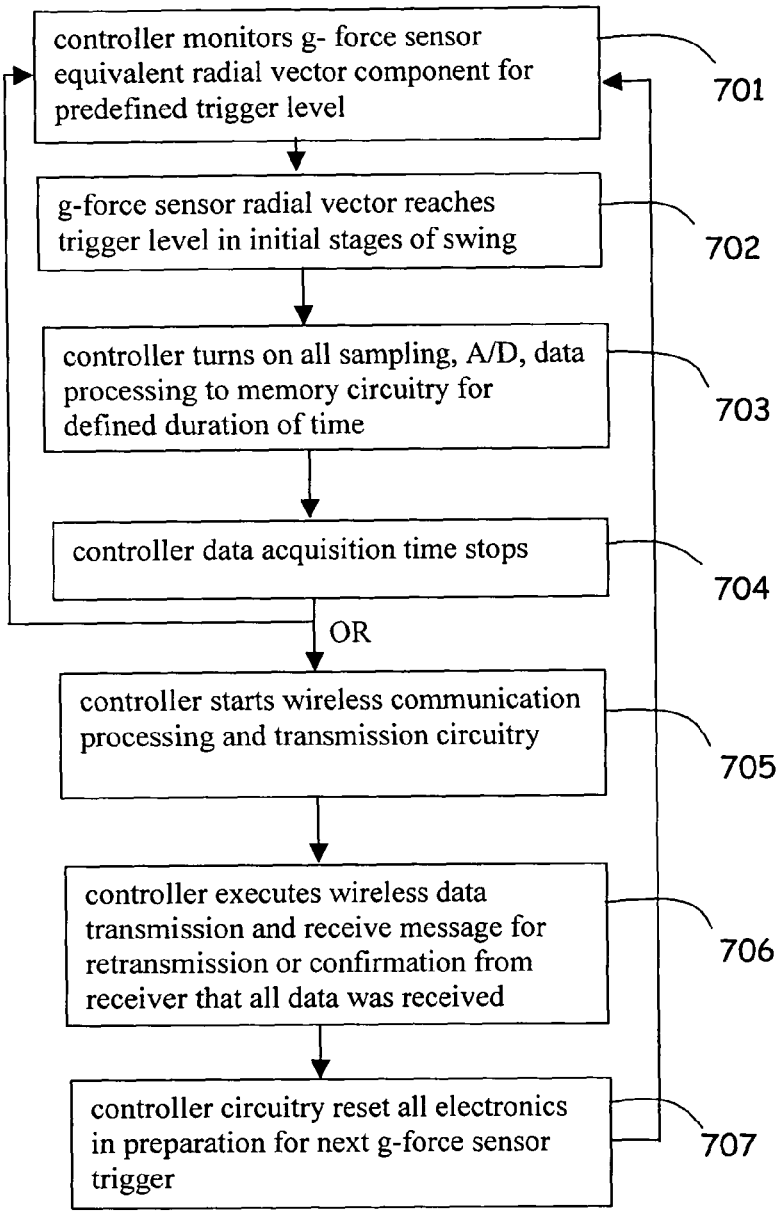
FIG. 6 is a block diagram detailing the processing steps for the trigger mechanism and commencement of data capture during the club swing and subsequent data transmission of the present invention.

As shown in FIG. 6, the controller organizes and controls the electrical processing of the signals based on triggers. When the club is turned on, the controller is monitoring the g-force sensor 20 or sensors for a predefined level of acceleration force 701. Once the predefined trigger level is met, the controller knows that a golf swing has started 702. The controller then brings out of sleep mode or turns on the circuitry required for all sampling, analog to digital conversion, timing and processing to memory functions for a defined period of time 703. This defined period of time can be either a preprogrammed duration of time or a acquisition circuitry stop function initiated by other trigger levels indicating the swing is substantially past the point in time of club head and ball impact, at which time the data acquisition stops 704. At this point the golfer can take more swings and have data stored in the club head memory in which case the controller goes back to step 701 or the controller further processes the data for transfer to a human interface function. In the preferred embodiment, this processing is preparation for wireless transmission 705. Next, the controller executes the wireless transmission to an external user interface apparatus, which includes transmission reception confirmation or if any data was corrupted during initial transmission, retransmission of those data blocks 706. Once all data has been confirmed as received, the controller resets all electronics in preparation for monitoring the g-force sensors for the next trigger 707.

Another option (not shown in FIG. 6) utilizes a manual switch that the golfer physically turns on before initiating his swing and turns off after completion of the swing. The switch initiates full data acquisition allowing the golfer to track acceleration dynamics of his entire swing including backswing and follow through.

Figure 7:
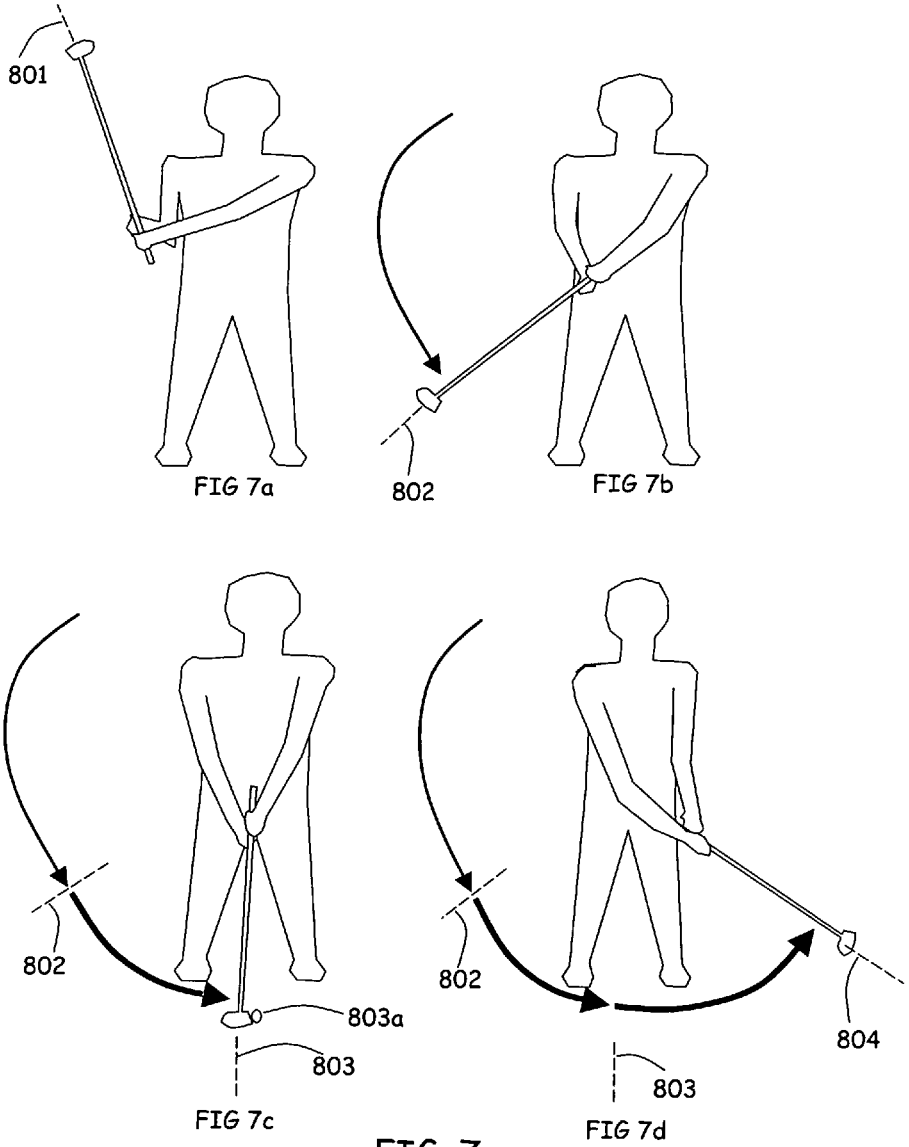
FIG. 7, depicting sub-figures 7*a*-7*d*, details a golfer swing time lapse showing associated data capture and processing steps of the present invention.

FIG. 7 shows the processing steps described in FIG. 6 in conjunction with a golfer's swing. In FIG. 7*a*, the golfer is starting his swing and the club movement and acceleration parameters are minimal at this point 801. In FIG. 7*b*, the club head acceleration parameters hit the defined trigger level and definitively indicate a swing is in progress at which point all of signal capture and processing circuitry is turned on 802. In FIG. 7*c*, the club makes contact 803 with the ball 803*a* and all of the data collection circuitry is still recording all sensor information. In FIG. 7*d*, the club stops recording sensor data at point 804.

Figure 8:
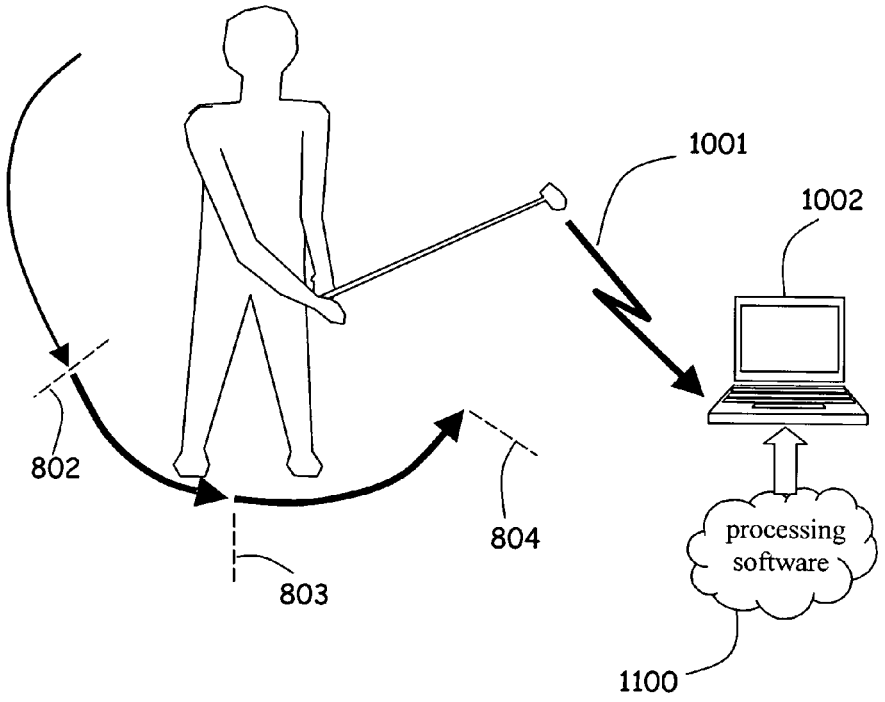
FIG. 8 details the present invention integrated golf club transmitting captured swing and impact data to a remote user interface wirelessly to a laptop computer.

FIG. 8 shows a preferred embodiment of the invention. The golf club transmits the measured data from the golf club to a remote user interface wirelessly 1001. The user human interface apparatus could be a smart phone, PDA, computer or custom wireless enabled thin or thick client device. In the preferred embodiment, the human interface apparatus is a laptop computer 1002. The laptop computer 1002 may have wireless abilities already built in for wireless communication such as WiFi, Bluetooth™, Zigbee™ or others. If the laptop doesn't have integrated wireless hardware and protocols to communicate wirelessly, a USB wireless adapter and associated software may be used. The laptop 1002 will have software 1100 running on it that is associated specifically with processing the time varying synchronized data from the golf club into golf performance metrics for human interpretation in many different user selectable and definable formats.

Figure 9:
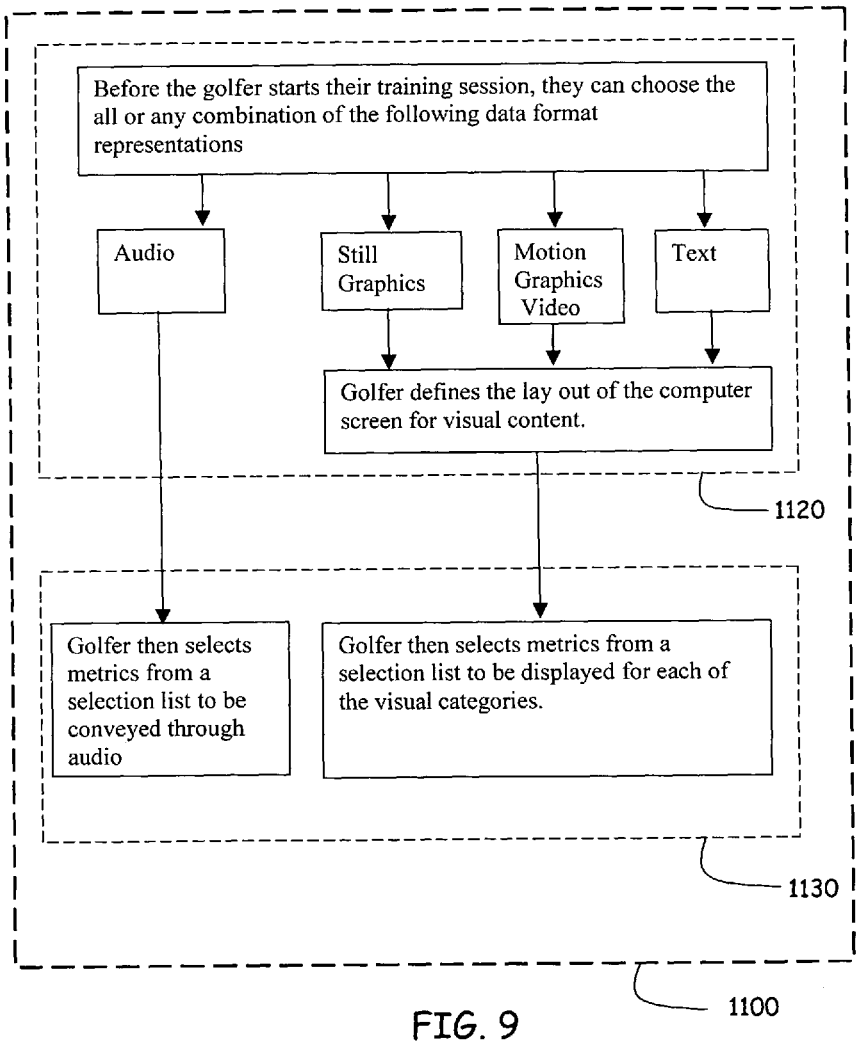
FIG. 9 is a block diagram of a user definable format portion of the data processing and human interface software running on a laptop computer of the present invention.

FIG. 9 shows the software 1100 capabilities and the structure of the program. The software 1100 will give great flexibility to the golfer as to how information is conveyed 1120 and what metrics information is conveyed 1130.

Figure 10:
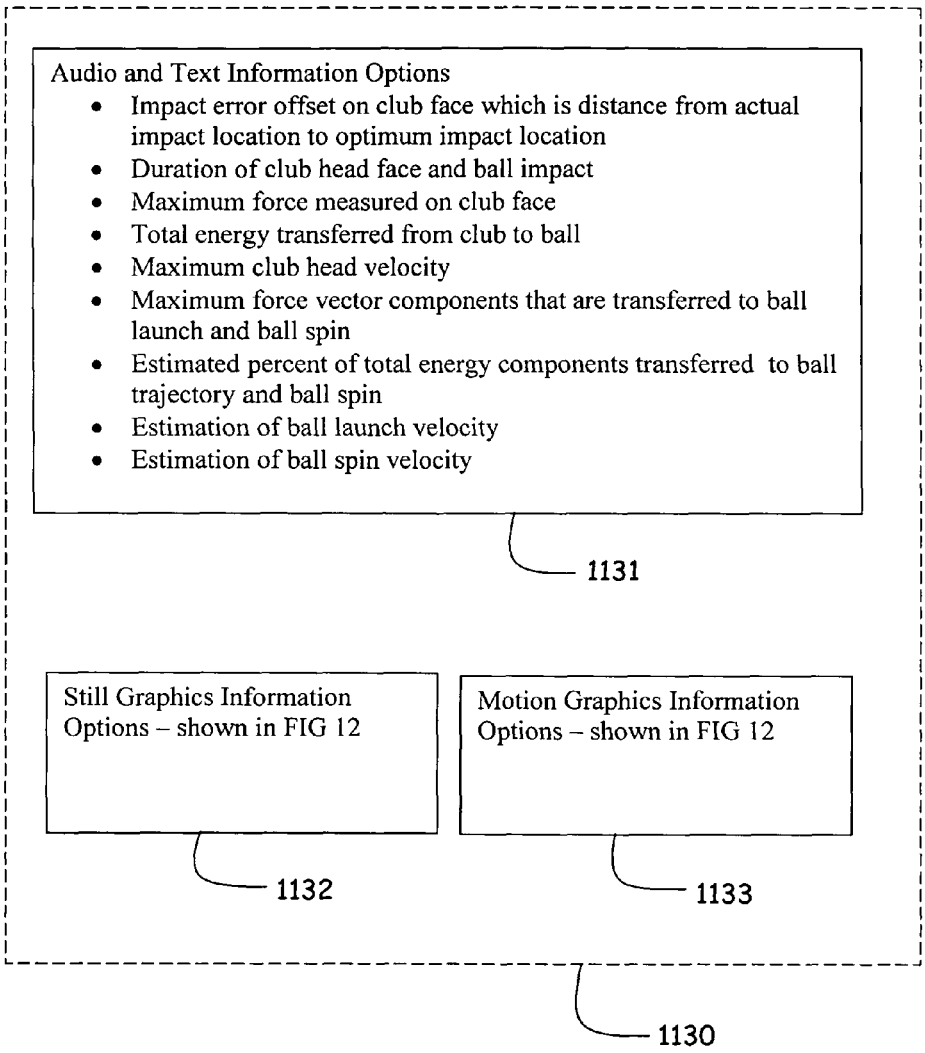
FIG. 10 is a block diagram of the present invention detailing user selectable content metrics that are available for the audio and text format options in the software.

As seen in FIG. 10, the metrics information 1130 that can be conveyed is broken into four categories: (1) audio; (2) text; (3) still graphics; and (4) motion graphics which are time dilation sequenced graphics that would play as a time expanded video of various time varying metrics. Since the content that can be displayed in text is the same content that can be conveyed through audio, which are scalar values, these two groups of user selectable metrics can be combined 1131. The available content for the still graphic options 1132 and the motion graphics options 1133 are more complex, therefore they each have their own unique selectable metrics lists.

Figure 11:
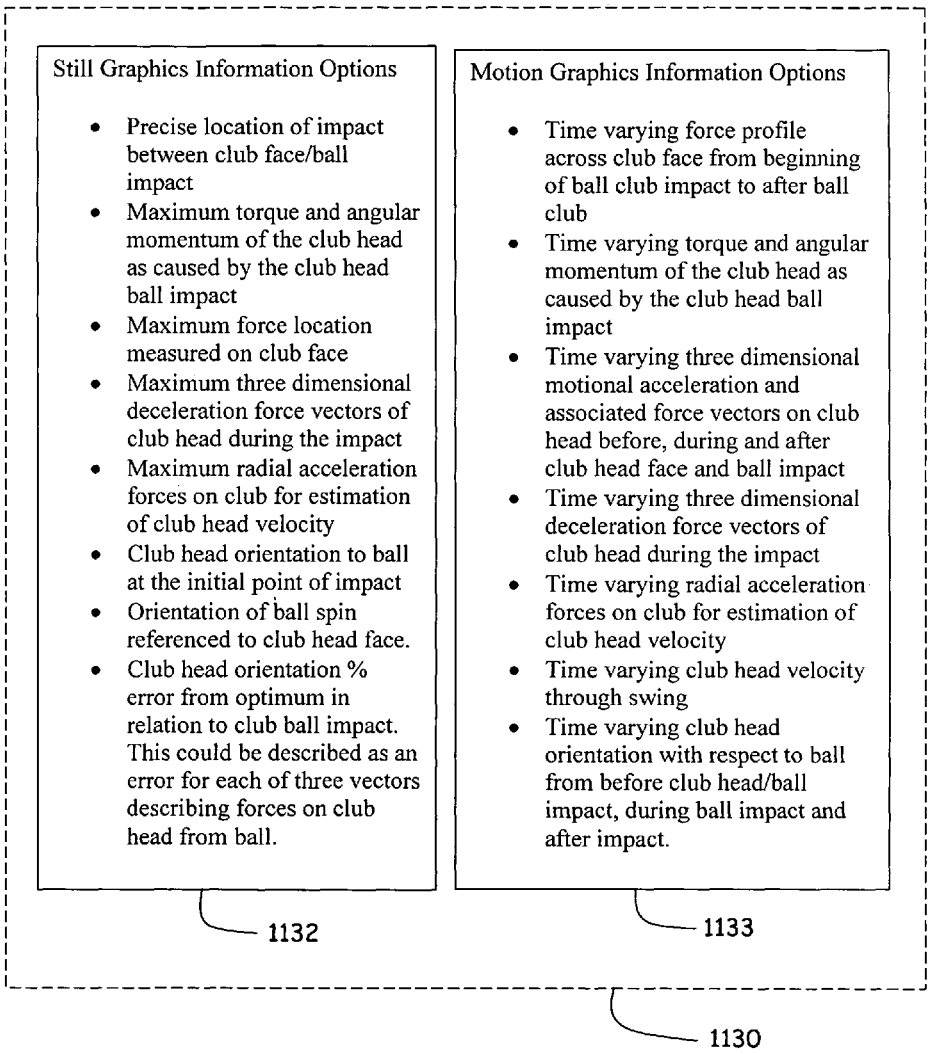
FIG. 11 a block diagram of the present invention detailing user selectable content metrics that are available for the still graphics and motion graphics format options in the software.

As shown in FIG. 11, the still graphic options 1132 and the motion graphics options 1133 are more complex in the sense they both convey three dimensional spatial metrics. However, the motion graphics 1133 adds the fourth dimension of time to create a powerful understanding for the golfer as to the dynamic nature of the metrics being presented.

Figure 12:
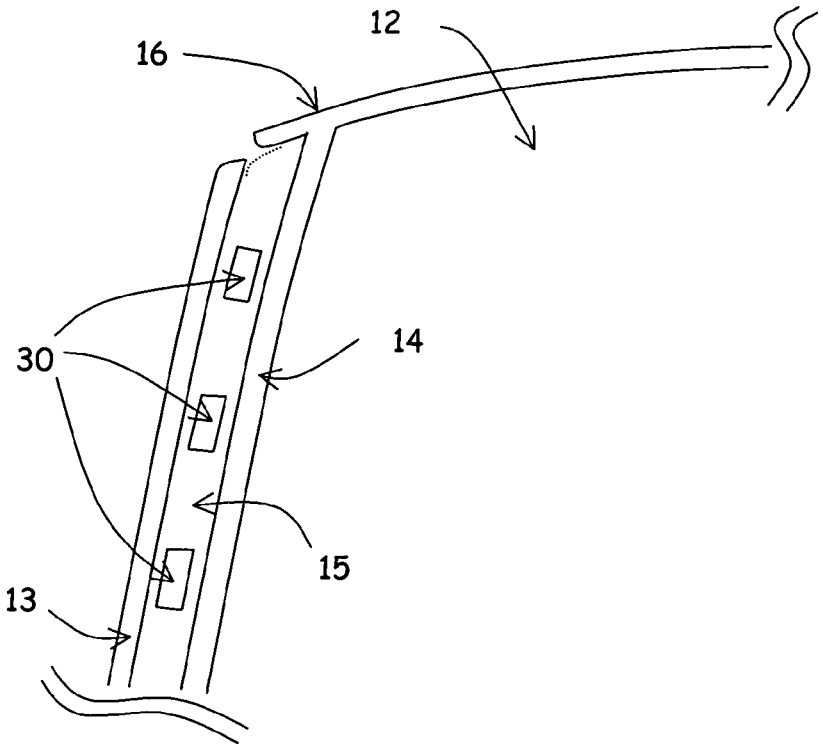
FIG. 12 is a partially exploded cross sectional view of an alternative embodiment of the club head face construction of the present invention showing two metal layers of which only the inner metal layer is rigidly attached to the club head housing.

FIG. 12 shows an alternative embodiment of the club head face construction where the outer metal layer 13 of the clubface 11 is not rigidly connected to the club head housing 16 and the inner layer 14 is rigidly connected the golf club head housing 16. The outer layer 13 is connected to the non-metallic, significantly hard monolith 15 that has the sensor array 30 embedded within it. The outer layer 13 is attached to the monolith material 15 with a strong durable adhesive. The monolith material 15 is also attached to the inner layer 14 with a durable adhesive. The inner layer 14 is rigidly connected to the club housing 16 with a welded seam as heretofore disclosed.

Figure 13:
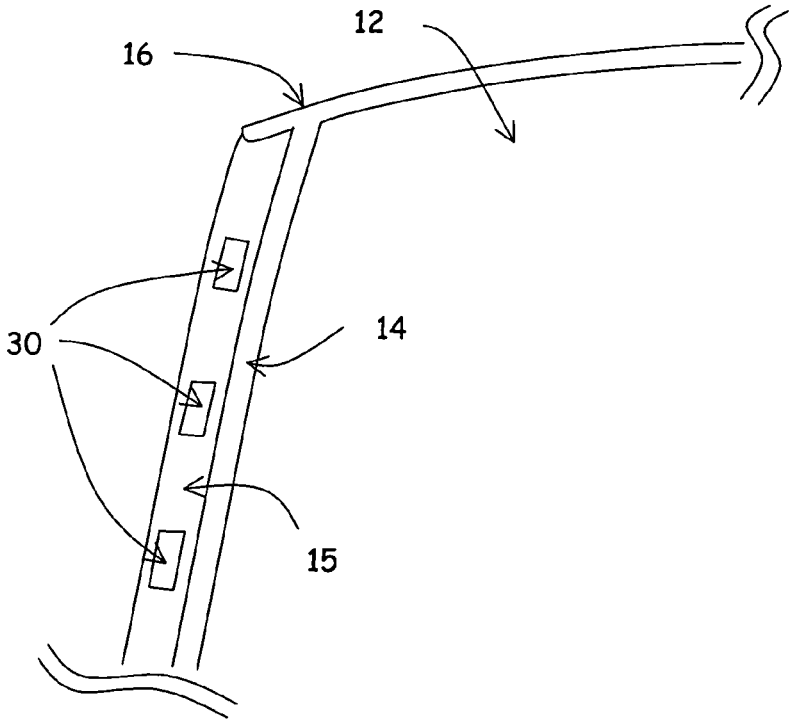
FIG. 13 is a partially exploded cross sectional view of an alternative embodiment of the club head face construction of the present invention showing a single metal layer and a hard material other than metal embedding the pressure force sensors that is the outer surface of the club head face.

FIG. 13 shows yet another embodiment of the club head face construction where there is only an inner metal layer 14 and the outer surface of the clubface 11 is the embedding material 15 that encapsulates the array of pressure force sensors 30. The embedding material 15 in this case is a non-conducting, very hard, durable non brittle material. Many materials exist that could be used and some example material families could be polycarbonates or very hard polymers. In this embodiment, the monolith material 15 is also attached to the inner layer 14 with a durable adhesive, while the inner layer 14 is rigidly connected to the club housing 16 with a welded seam.

As shown in FIG. 14, a preferred embodiment has two, three dimensional g-force sensors. An inner three dimensional g-force sensor 20*a* mounted on the axial center of gravity 41 of the club head 10 near where the club shaft connects, and an outer three dimensional g-force sensor 20*b* that is also mounted on the axial center of gravity 41 but on the other side of the club head and at an equal distance from the center of gravity 40 as that of the inner three dimensional g-force sensors 20*a*. In addition, each sensor's axial domain will have one axis normal to the clubface and one axis coincident with the axial center of gravity 41. There can be any reasonable number of the three dimensional g-force sensors 20 mounted in the golf club head 10 and that are not aligned with the center of gravity or associated axis. However, as long as the sensors' positions and orientations are known in relation to the mass distribution of the club head, the needed calculations can be made. By utilizing relationships to the center of gravity, the calculations are simplified.

Figure 15:
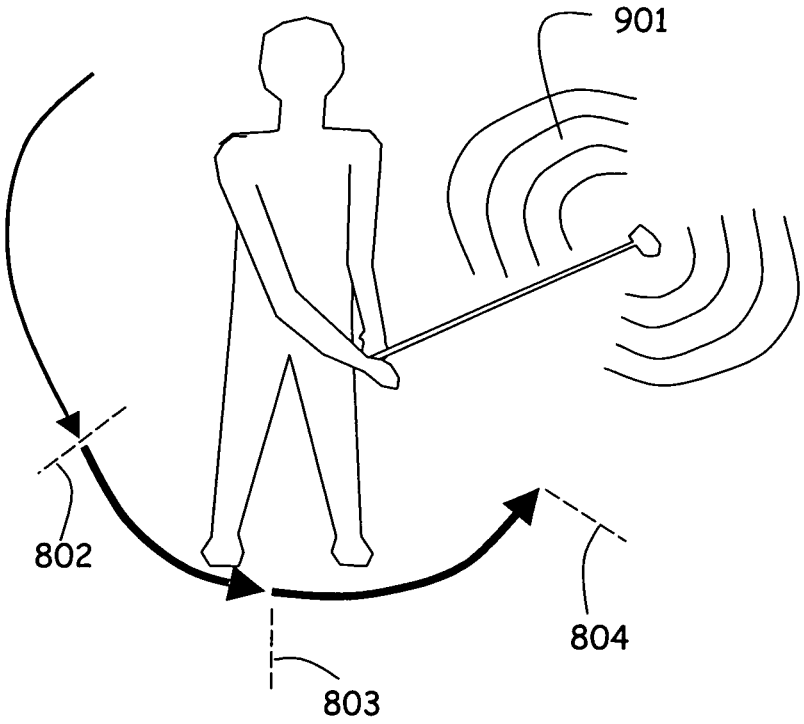
FIG. 15 details an alternative embodiment of the present invention showing the integrated golf club communicating results directly from the club to the golfer using audio means.

FIG. 15 shows one embodiment after the point in time when the electronics stop collecting data 804. The collected data is processed in the club head into key metrics that are useful to the golfer. These metrics are then communicated to the golfer directly from the golf club. The metrics content can be conveyed in several forms, one of which is an audible signal or sequence of audible signals from the club 901 such as a synthesized voice stating metrics. Other forms of communication from the golf club to the golfer could include signals that are vibrated through the club handle for privacy or temperature variations in the club handle.

Figure 16:
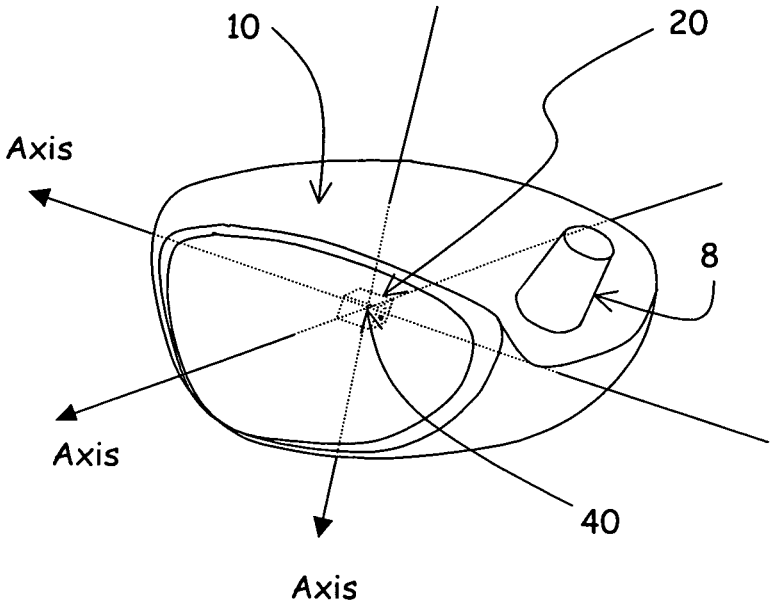
FIG. 16 depicts a perspective view of a further alternative embodiment of the present invention that does not utilize pressure force sensors.

FIG. 16 shows an alternative embodiment that only encompasses one or more g-force sensors 20, without any pressure force sensors 30 included. The golf club invention of this design offers a subset of metrics that include:

1. Total energy transferred from club to ball;
2. Time varying three dimensional motional acceleration and associated force vectors on club head before, during and after club head face and ball impact;
3. Radial acceleration forces on the club for an estimation of club head velocity;
4. Three dimensional deceleration force vectors of club head during the club/ball impact;

Although specific embodiments of the invention have been disclosed, those having ordinary skill in the art will understand that changes can be made to the specific embodiments without departing form the spirit and scope of the invention. The scope of the invention is not to be restricted, therefore, to the specific embodiments. Furthermore, it is intended that the appended claims cover any and all such applications, modifications, and embodiments within the scope of the present invention.

Figure 17:
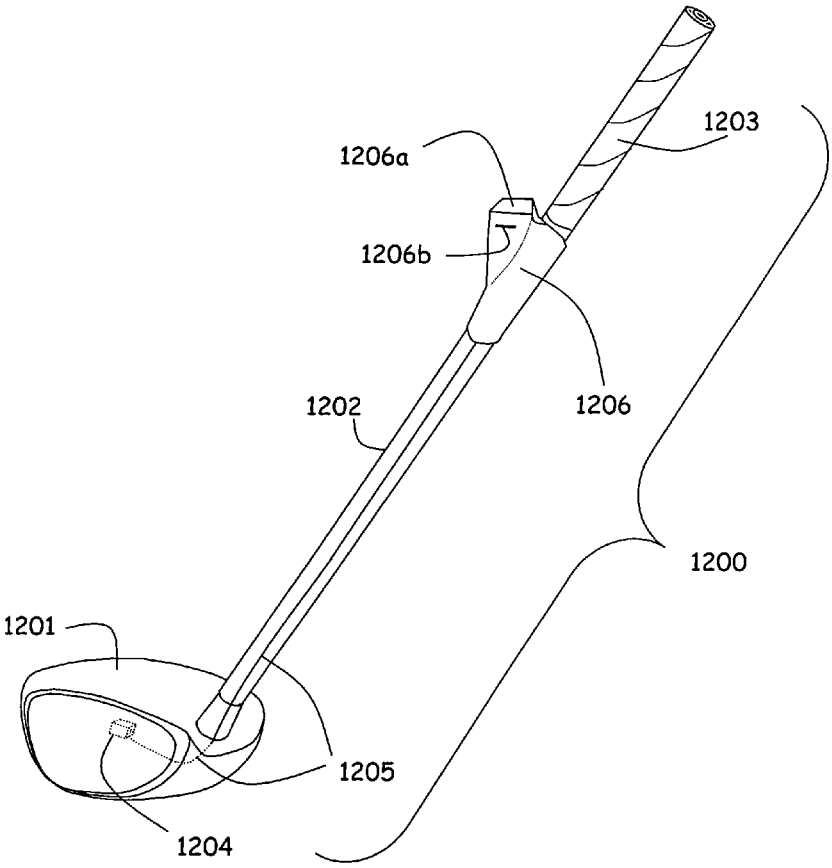
FIG. 17 depicts another alternative embodiment where the electronic module is combined with a display module and mounted on a golf club shaft, with one or more single or multi-dimensional acceleration g-force sensor or sensors mounted in the club head.

FIG. 17 shows yet still another alternative embodiment that is a golf club 1200 with golf club head 1201, a golf club shaft 1202 and a grip 1203 on the shaft 1202. In this embodiment, the golf club head 1201 can have either a one dimensional or two dimensional acceleration g-force sensor 1204. The one dimensional g-force sensor or sensors 1204 is connected through wire 1205 to electronic circuitry and display module 1206 connected to the club shaft 1202 near the golf club hand grip 1203. The human interface display screen 1206*a* can be of graphics or text format such as OSRAM's Pivtiva™ OLED models or Varitronic™ LCD models, respectively. The electronic circuitry and display module 1206 collect signals from the g-force sensor or sensors 1204, processes those signals, converts the signals to metrics and displays the metrics regarding the swing of the golf club on the display 1206*a*.

The electronic module may also have the ability to receive data from the golfer, such as arm length, which can be used for calculations of golf club head velocity. In this form of the invention, the arm length datum is input into the electronic circuitry and display module 1206 by a smart wheel 1206*b*, or some such other similar means.

We claim:

1. A golf club head comprising:

at least one permanently internal three-dimensional motional acceleration force sensor that simultaneously detects acceleration in three different directions while the golf club head is swinging;

at least two permanently internal impact pressure force sensors embedded in a non-conductive monolith structure that is embedded within a face of the golf club head; and electronic circuitry including a controller, within the head, connected to the at least one three-dimensional motional acceleration force sensor and the at least two internal impact pressure force sensors, wherein the electronic circuitry simultaneously samples outputs from the at least two internal impact pressure force sensors, capturing at least two samples at substantially the same point in time that are used to describe a time-varying impact pressure force profile across the club head face during an impact between the club head face and a ball, wherein a first impact pressure force sensor, that is nearer to an outer edge of the club face where the club face meets a club head housing than a second impact pressure force sensor, is calibrated differently than the second impact pressure force sensor such that the electronic circuitry compensates for deformation pressure differences on the monolith.

2. The golf club head of claim 1, wherein at least five internal impact pressure force sensors are embedded in the monolith within said face.

3. The golf club head of claim 1, wherein the golf club head further includes a transmitter that transmits the simultaneous samples to a receiver unit, wherein the receiver unit uses the simultaneous samples to describe the time-varying impact pressure force profile.

4. The golf club head of claim 1, wherein a golf club shaft is coupled thereto.

5. A combination of a golf club and a human interface interactive with said club, said club comprising:

a golf club shaft;

a golf club head connected to said shaft wherein said head comprises:

at least one permanently internal three dimensional motional acceleration force sensor, wherein the force sensor simultaneously detects acceleration in three different directions; and at least two permanently internal impact pressure force sensors embedded within a monolith in a club face;

electronic circuitry including a controller internal to said head and connected to said sensors wherein said circuitry captures golf swing dynamics data from said sensors relative to said golf club striking a golf ball, wherein the electronic circuitry simultaneously samples outputs from the at least two internal impact pressure force sensors, capturing at least two samples at substantially the same point in time that are used to describe a time-varying impact pressure force profile across the club head face during an impact between the club head face and a ball, wherein a first impact pressure force sensor, that is nearer to an outer edge of the club face where the club face meets a club head housing than a second impact pressure force sensor, is calibrated differently than the second impact pressure force sensor to compensate for deformation pressure differences on the monolith; and a transmitter operable to transmit said data to said human interface.

6. A method of capturing golf swing dynamics data from swinging a golf club and transmitting said data to a human interface, the method comprising:

providing a golf club having:

a golf club shaft;

a golf club head connected to said shaft, said golf club head having a golf club face;

at least one permanently internal three dimensional motional acceleration force sensor within the golf club head, wherein the force sensor simultaneously detects acceleration in three different directions; and at least two permanently internal impact pressure force sensors embedded within a non-conductive monolith in said face of said golf club head;

connecting said sensors to electronic circuitry that includes a controller; and capturing with said electronic circuitry golf swing dynamics data from said sensors relative to swinging said golf club and relative to striking a golf ball with the said golf club, wherein the electronic circuitry simultaneously samples outputs from the at least two internal impact pressure force sensors at approximately the same point in time, the impact pressure force samples being used to capture a time-varying impact pressure force profile across the club head face during an impact between the club head face and a ball, wherein the capturing includes compensating for decreased deformation differences on the monolith, where the compensation is based at least in part on a first impact pressure force sensor that is nearer to an outer edge of the club face where the club face meets the club head housing, being calibrated differently than a second impact pressure force sensor.

7. the method of claim 6, further comprising calibrating the first impact pressure force sensor relative to its location within said club face differently than the second impact pressure force sensor to compensate for the decreased deformation of the monolith under the same amount of pressure.

8. The golf club head of claim 1, wherein the at least two internal impact pressure force sensors include at least two piezoelectric internal impact pressure force sensors.

9. The golf club head of claim 1, wherein the at least two internal impact pressure force sensors include an array of at least three piezoelectric impact pressure force sensors within a face of said club head.

10. The method of claim 6, wherein the at least two internal impact pressure force sensors include an array of at least three piezoelectric internal impact pressure force sensors.

11. The method of claim 6, wherein the at least two internal impact pressure force sensors include at least two piezoelectric internal impact pressure force sensors.

12. The method of claim 11, wherein the golf swing dynamics data includes a time-varying force profile across the golf club face.

13. The method of claim 11, wherein the golf swing dynamics data includes an orientation of the club head at a point of impact with a ball.

14. The method of claim 11, wherein the golf swing dynamics data includes an orientation of ball spin with reference to the club head face.

15. The method of claim 11, wherein the golf swing dynamics data includes time varying three dimensional motional acceleration and associated force vectors on the club head.

16. The method of claim 11, wherein the golf swing dynamics data includes at least one of:

a maximum force applied to the club head face;

a total energy transferred from the golf club to a ball; and three dimensional deceleration force vectors of the club head during an impact between the golf club and a ball.

17. A golf club head comprising:

at least one permanently internal three-dimensional motional acceleration force sensor within said golf club head and operable to measure three-dimensional motional acceleration forces on said golf club head during a golf club swing from a point in time before an initial impact between said golf club head and a ball until a point in time after a separation of said golf club head and said ball;

an array of permanently internal impact pressure force sensors distributed across a non-conductive monolith within a face region of said golf club head and operable to measure impact pressure forces that occur across said face region for a duration of impact between said face region and a ball; and electronic circuitry including a controller, within the head, connected to the at least one three-dimensional motional acceleration force sensor and the array of internal impact pressure force sensors, wherein the electronic circuitry simultaneously samples the outputs from the array of internal impact pressure force sensors at approximately the same point in time, the samples of the outputs being used to capture a time-varying impact pressure force profile across the club head face during an impact between the club head face and a ball, wherein a first impact pressure force sensor, that is nearer to an outer edge of the club face where the club face meets the club head housing than a second impact pressure force sensor, is calibrated differently than the second impact pressure force sensor to compensate for deformation pressure differences on the monolith.

18. The golf club head of claim 17, further comprising a transmitter communicatively coupled to the at least one three-dimensional motional acceleration force sensor and the array of internal impact pressure force sensors and operable to transmit data indicative of at least one of:

the three-dimensional motional acceleration forces to a remote receiving unit; and the impact pressure forces that occur across said face region.

19. The golf club head of claim 17, wherein at least one of the impact pressure force sensors comprises a piezoelectric internal impact pressure force sensor.

20. The golf club head of claim 17, wherein the golf club head is free of sensors that are selectively externally removable from the head.

* * * * *

UNITED STATES PATENT AND TRADEMARK OFFICE

CERTIFICATE OF CORRECTION

PATENT NO. : 9,084,925 B2
APPLICATION NO. : 12/287303
DATED : July 21, 2015
INVENTOR(S) : Roger Davenport et al.

It is certified that error appears in the above-identified patent and that said Letters Patent is hereby corrected as shown below:

In the claims,

Column 12:

Claim 6, lines 32-33, "the club head housing" should read --a club head housing--

Column 14:

Claim 17, line 7, "the club head housing" should read --a club head housing--

Signed and Sealed this
Fifteenth Day of March, 2016

Michelle K. Lee

Michelle K. Lee
*Director of the United States Patent and Trademark Office*